US009558904B2

(12) United States Patent
Luna

(10) Patent No.: US 9,558,904 B2
(45) Date of Patent: Jan. 31, 2017

(54) FUSE

(71) Applicant: MTA S.p.A., Codogno (IT)

(72) Inventor: Ricardo Luis Gonzàlez Luna, Codogno (IT)

(73) Assignee: MTA S.P.A., Codogno (IT)

( * ) Notice: Subject to any disclaimer, the term of this patent is extended or adjusted under 35 U.S.C. 154(b) by 126 days.

(21) Appl. No.: 14/378,898

(22) PCT Filed: Feb. 14, 2013

(86) PCT No.: PCT/IB2013/051200

§ 371 (c)(1),
(2) Date: Aug. 14, 2014

(87) PCT Pub. No.: WO2013/121373

PCT Pub. Date: Aug. 22, 2013

(65) Prior Publication Data

US 2015/0009008 A1 Jan. 8, 2015

(30) Foreign Application Priority Data

Feb. 15, 2012 (IT) ..... MI2012A0215

(51) Int. Cl.

| | |
|---|---|
| ***H01H 85/08*** | (2006.01) |
| ***H01H 85/143*** | (2006.01) |
| ***H01H 85/10*** | (2006.01) |
| *H01H 85/045* | (2006.01) |

(52) U.S. Cl.

CPC ..... *H01H 85/08* (2013.01); *H01H 85/10* (2013.01); *H01H 85/143* (2013.01); *H01H 85/0454* (2013.01); *H01H 2231/026* (2013.01)

(58) Field of Classification Search

CPC ..... H01H 85/10; H01H 85/143; H01H 85/08; H01H 85/0454; H01H 2231/026

USPC ..... 337/292, 295

See application file for complete search history.

(56) References Cited

U.S. PATENT DOCUMENTS

| | | | | | |
|---|---|---|---|---|---|
| 1,441,550 | A * | 1/1923 | Weston | H01H 85/10 | 337/295 |
| 1,774,252 | A * | 8/1930 | Bussmann | H01H 85/10 | 337/164 |
| 3,386,062 | A * | 5/1968 | Kozacka | H01H 85/10 | 337/160 |
| 4,322,704 | A * | 3/1982 | Kozacka | H01H 85/055 | 337/159 |
| 4,488,137 | A * | 12/1984 | Rooney | H01H 85/055 | 337/162 |

(Continued)

FOREIGN PATENT DOCUMENTS

| | | |
|---|---|---|
| DE | 102008036672 B3 | 3/2010 |
| WO | 03075298 A1 | 9/2003 |

*Primary Examiner* — Anatoly Vortman

(74) *Attorney, Agent, or Firm* — Alan G. Towner, Esq.; Pietragallo Gordon Alfano Bosick & Raspanti, LLP

(57) ABSTRACT

A fuse comprises two electric contacts with a contact width, a fuse element disposed between two opposed fuse ends and comprising a first fuse having a minimum-section part with a first width and a first section. The fuse element further comprises at least one second fuse disposed between the first fuse and one of said two fuse ends. The second fuse comprises a narrowed part with a second width smaller than the first width and the contact width and with a second section ranging from 20% to 50% of the first section.

6 Claims, 3 Drawing Sheets

(56) References Cited

U.S. PATENT DOCUMENTS

| | | | | | |
|---|---|---|---|---|---|
| 4,731,600 | A | * | 3/1988 | Rosen | H01H 85/055 337/159 |
| 4,751,490 | A | * | 6/1988 | Hatagishi | H01H 85/10 337/166 |
| 5,528,213 | A | * | 6/1996 | Kondo | H01H 85/10 337/160 |
| 5,739,741 | A | * | 4/1998 | Hanazaki | H01H 85/11 337/160 |
| 5,745,023 | A | * | 4/1998 | Totsuka | H01H 85/0417 337/160 |
| 5,917,399 | A | * | 6/1999 | Ishii | H01H 85/055 337/142 |
| 5,929,740 | A | * | 7/1999 | Oh | H01H 85/0417 337/180 |

* cited by examiner

FUSE

FIELD OF THE INVENTION

The present invention relates to a fuse.

Particularly, the fuse of the present invention finds application in the automotive field for protection of power consuming units.

BACKGROUND INFORMATION

A typical fuse is composed of two electric contacts, with a fuse element disposed therebetween and a casing made of an insulating material and adapted to house the fuse element and the connecting ends of the electric contacts to the fuse element.

When one of the electric contacts receives a current value exceeding a preset fusing current threshold, the fuse element melts and stops power supply to the power consuming unit connected to the other electric contact, thereby protecting it from current peaks.

Nevertheless, prior art fuses have an unsatisfactory operation at high overcurrent values, i.e. of the order of 8-10 times the rated current of the fuse.

Prior art fuses are disclosed, for instance in WO 03/075298, DE 10 2008 036672 and U.S. Pat. No. 4,751,490.

Particularly, at low overcurrent values, i.e. of the order of 1.35-6 times the rated current of the fuse, such fuses have melting times that remain within the maximum and minimum limits set by ISO standards. However, at high overcurrent values, i.e. of the order of 8-10 times the rated current of the fuse, they have an asymptotic behavior that does not ensure low operation times. In other words, at values of the order of 8-10 times the rated current of the fuse, the operation times, i.e. the melting times, remain substantially constant.

Therefore, it would be desirable to have fuses that can ensure low melting times both at low overcurrent values and at high overcurrent values, and particularly melting times that continuously decrease as overcurrent values increase.

SUMMARY OF THE INVENTION

The object of the present invention is to provide a fuse that can fulfill this need.

This object is fulfilled by a fuse as defined in claim 1 comprising: two electric contacts, each electric contact extending in a prevailing longitudinal contact direction and comprising a contact portion which is designed to establish an electric contact with a mating contact and a contact end, said electric contact having, at least at said contact end, a contact width extending in the direction perpendicular to said longitudinal contact direction, a fuse element extending in a prevailing longitudinal fuse direction along a fuse length between two opposed fuse ends, each fuse end being directly connected and directly adjacent to a respective contact end said fuse element comprising a first fuse extending in the longitudinal fuse direction along a first fuse length between its respective fuse end and a connecting end, said first fuse having, at a minimum-section portion thereof, a first width in the direction perpendicular to said longitudinal fuse direction, and a first section, at least one second fuse extending in the longitudinal fuse direction along a second fuse length between said connecting end and its respective fuse end, such that said second fuse is connected in series to said first fuse and is disposed between said first fuse and said respective fuse end, wherein: said second fuse comprises a narrowed part with a second width in the direction perpendicular to said longitudinal fuse direction, and a second section, said second section ranges from 20% to 50% of said first section.

BRIEF DESCRIPTION OF THE DRAWINGS

Further features and advantages of the fuse of the present invention will result from the following description of one preferred embodiment, which is given by way of illustration and without limitation with reference to the accompanying figures, in which.

DETAILED DESCRIPTION

Figure 1:
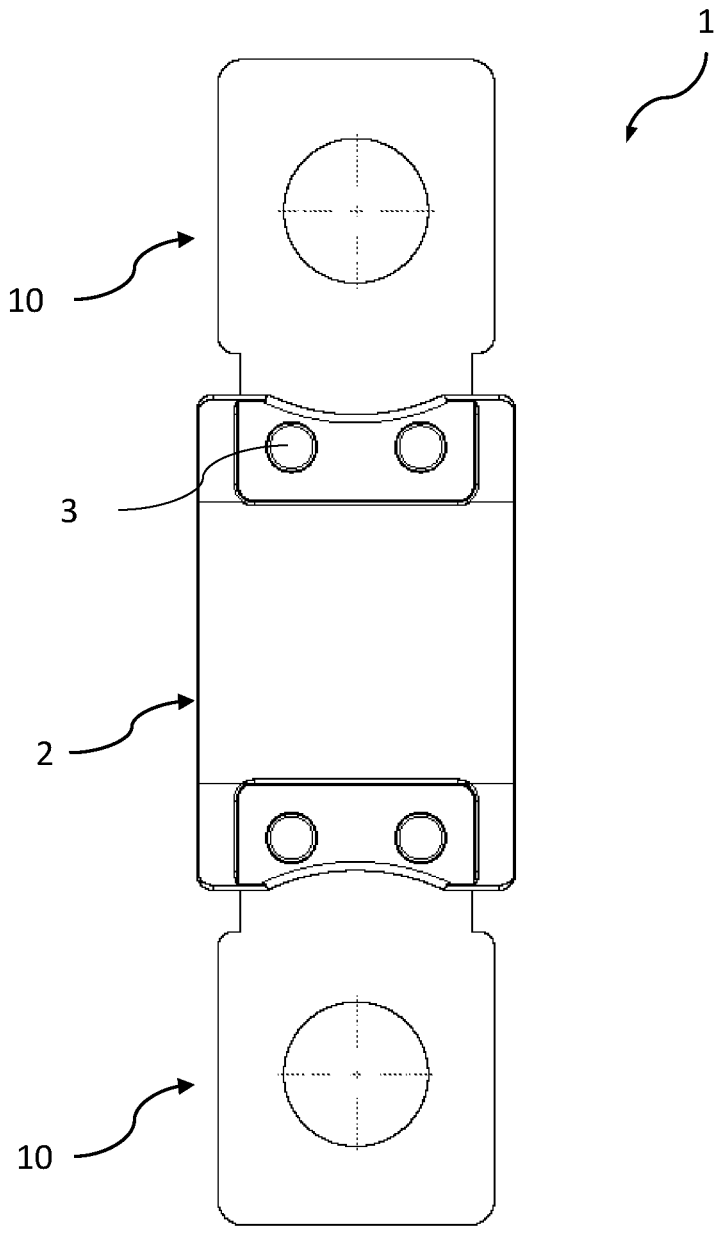
FIG. 1 is a diagrammatic plan view of a fuse of the present invention.
Figure 2:
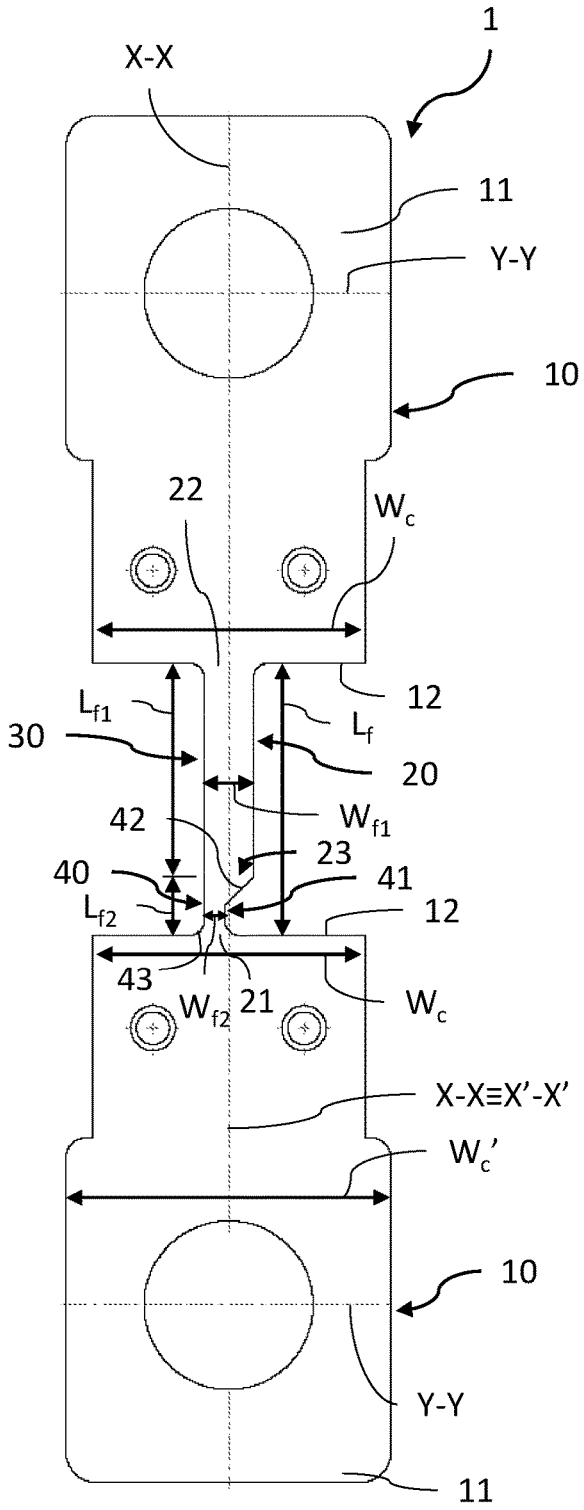
FIG. 2 is a diagrammatic plan view of the foil element of the fuse of FIG. 1.
Figure 3:
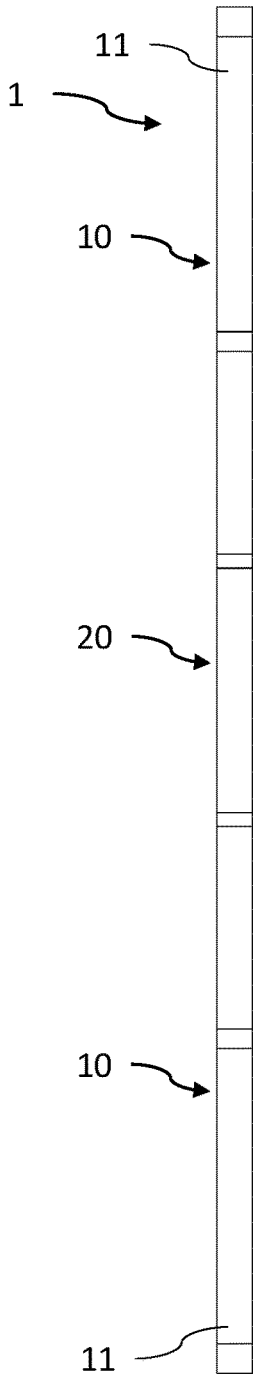
FIG. 3 is a schematic side view of the foil element of the fuse of FIG. 2.

Referring to the annexed figures, numeral 1 generally designates a fuse of the present invention.

The fuse 1 comprises two electric contacts, here both referenced 10, and a fuse element 20.

In the example of the figures, the fuse is of the flat type and the two electric contacts 10 lie on the same plane as the fuse element 20. Nevertheless, the present invention also applies to fuses of other types, such as fuses in which the two electric contacts 20 are arranged on separate parallel planes, with respective inner edges or with respective flat contact surfaces in mutually facing relationship.

The electric contacts 10 may be made of a Cu or Zn alloy.

The fuse 1 also comprises a casing 2, typically made of plastic, which defines a housing for the fuse element 20 and for at least part of each electric contact 10.

The casing 2 is typically made of plastic and may be composed of two shells fastened together by fastener means 3.

Each electric contact 10 extends in a prevailing longitudinal direction X-X and comprises a contact portion 11 which is designed to establish an electric contact with a mating contact and a contact end 12.

At least at the contact end 12, each electric contact 10 has a contact width Wc in the Y-Y direction, which is perpendicular to the longitudinal contact direction X-X.

In one embodiment, each electric contact 10 has substantially the same contact width Wc throughout its longitudinal length. In the example of the figures, the electric contacts 10 have an area with a contact width Wc and an area with a contact width Wc' greater than Wc. The area with the contact width Wc acts as a conductor area, whereas the area with the width Wc' acts as a contact for a mating contact.

The contact width Wc may range from 10 mm to 16 mm, with appropriate tolerances. In this example, the contact width Wc is 13.7 mm, and the width Wc' is 16 mm.

The fuse element 20 extends in a prevailing longitudinal direction X'-X', which coincides in this example with the direction X-X of the electric contact 10, along a fuse length Lf, between two opposed fuse ends 21, 22. Each fuse end 21, 22 is directly connected and is located directly adjacent to a respective contact end 12. It shall be noted that the direction X'-X' may not coincide with the direction X-X and that such direction X'-X' may be either rectilinear, like in the example of the figures, or curvilinear.

The fuse element 20 may be also made of a Cu or Zn alloy.

The fuse element 20 comprises a first fuse 30 that extends in the direction X'-X' along a first length Lf1 between its respective fuse end 22 and a connecting end 23. At a minimum-section portion, the first fuse 30 has a first width Wf1 in the direction Y-Y perpendicular to the longitudinal direction X'-X', and a first section Sf1. For example, the width Wf1 may range from 1.5 mm to 2.5 mm, with appropriate tolerances. Assuming a constant thickness of 1 mm, the section Sf1 will range from 1.5 mm2 to 2.5 mm2.

The fuse element 20 also comprises a second fuse 40 that extends in the direction X'-X' along a second length Lf2 between the connecting end 23 and its respective fuse end 21, such that the second fuse 40 is connected in series to the first fuse 30 and is disposed between the first fuse 30 and its respective fuse end 21.

In an alternative embodiment, the second fuse 40 may be disposed between the first fuse 30 and the fuse end 22 or two second fuses 40 may be provided, each disposed between the first fuse 30 and a corresponding fuse end 21, 22.

The second fuse 40 comprises a narrowed part 41 with a second width Wf2 in the direction Y-Y perpendicular to the direction X'-X' and a second section Sf2.

In this example, the second width Wf2 is smaller than the first width Wf1 and the contact width Wc.

Particularly, in this example, the width Wf2 may range from 0.8 mm to 1.2 mm, with appropriate tolerances. Assuming a constant thickness of 1 mm, the section Sf2 will range from 0.8 mm2 to 1.2 mm2.

Furthermore, the second section Sf2 ranges from 20% to 50% of the first section Sf1.

At low overcurrent values, i.e. of the order of 1.35-6 times the rated current I_0, the narrowed part 41 of the second fuse 40, with the second section Sf2, has no significant effect on the behavior of the fuse element 20. This is because it contacts a large thermal mass, i.e. the electric contact 10 and hence, as a result of these overcurrents, it causes the second fuse 40 to have considerably longer melting times than those required for melting the first fuse 30. Therefore, at these overcurrent values, the second fuse 40 does not melt, while the first fuse 30 does.

At high overcurrents, i.e. of the order of 8-10 times the rated current I_0, the narrowed part 41 causes the second fuse 40 to have considerably shorter times than those required for melting the first fuse 30. Therefore, at these overcurrent values, the first fuse 30 does not melt, while the second fuse 40 does, which ensures considerably shorter operation times, as compared with those that would be obtained using the first fuse 30 only.

In short, the fuse 1 can maintain the fusing times required for automotive fuses in a range of 1.35-6 times the rated current I_0 of the fuse 1, and also ensures much shorter operation times at overcurrents of the order of 8-10 times the rated current I_0 of the fuse 1.

According to one embodiment, the narrowed part 41 is located distal to the connecting end 23, near its respective fuse end 21.

Particularly, the narrowed part 41 is placed near its respective contact end 12. Thus, at least one contact 10 is directly adjacent to the narrowed part 41 which, as mentioned above, has a section Sf2 ranging from 20% to 50% of the minimum section Sf1 of the first fuse 30.

According to one embodiment, the width Wf2 ranges from 20% to 50% of the width Wf1 assuming a constant thickness of the fuse element 20. In this case the above mentioned ratio of the section Sf2 to the section Sf1 is fulfilled. If the fuse element 20 has a variable thickness, the ratio of the sections Sf2 to Sf1 is always fulfilled, but the ratio of the widths Wf2 to Wf1 not necessarily is.

In one embodiment, the length Lf2 ranges from the width Wf2 to three times the width Wf2.

The second fuse 40 may be arranged to extend along the length Lf2, with a substantially constant width, equal to the second width Wf2.

Alternatively, the second fuse 40 comprises at least one tapered part connecting the narrowed part 41 to one of the connecting end 23 and the fuse end. Here, such tapered part has a width increasing from the width Wf2 to the width Wf1 or the contact width Wc.

In the example of the figures, the second fuse 40 comprises two tapered parts 42, 43 connecting the narrowed part 41 to the connecting end 23 on the one hand and the fuse end 21 on the other hand. Such tapered parts 42, 43 have a width increasing from the width Wf2 to the width Wf1 and the contact width Wc respectively.

It shall be noted that the shape of the narrowed part 41 and the shape of the tapered parts 42, 43 and their positions and longitudinal lengths may change, provided that the section Sf2 ranges from 20% to 50% of the section Sf1, which means that, assuming a constant thickness of the fuse element 20, the width Wf2 shall range from 20% to 50% of the width Wf1.

Figure 4:
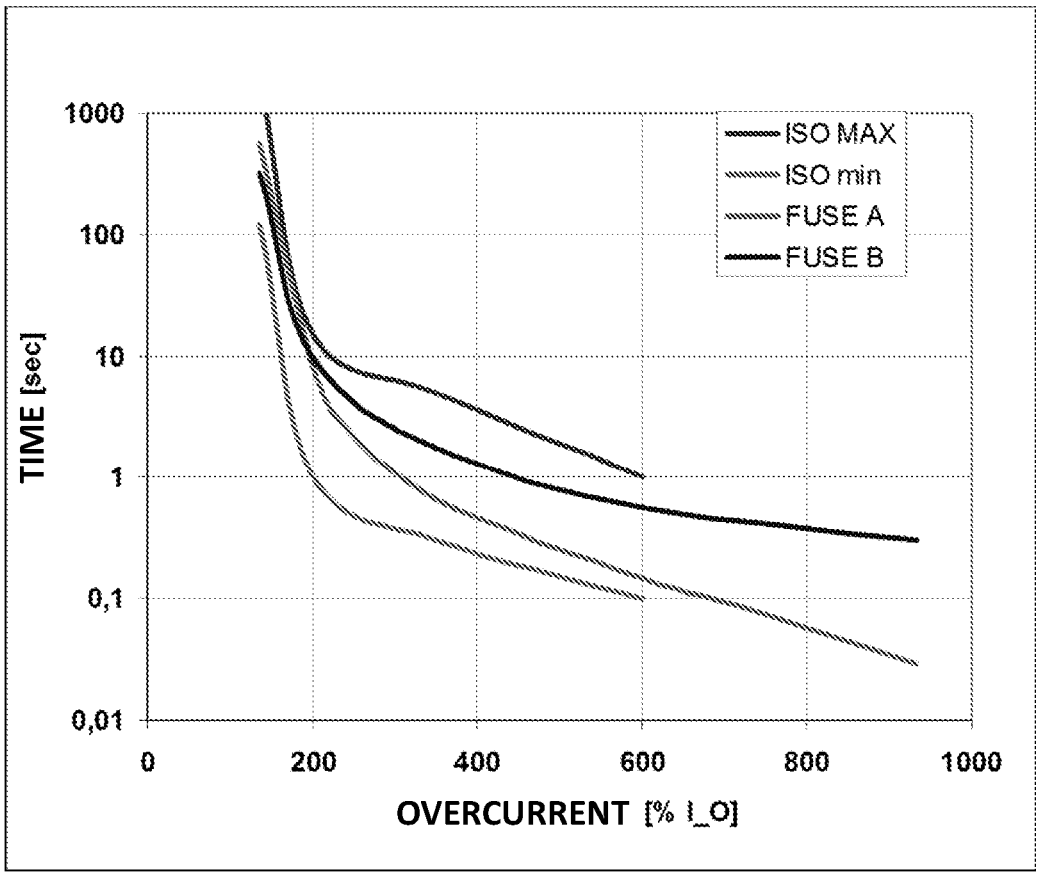
FIG. 4 shows results of comparative tests conducted on the fuse of the present invention.

Tests were carried out by the applicant, and their results are shown in FIG. 4.

The applicant made a fuse from a Zn alloy, as shown in the figures, with a width Wf1 of 2.5 mm, a width Wf2 of 1.05 mm and electric contacts with a contact width Wc of 13.7 mm and a width Wc' of 16 mm, and a uniform thickness of 1.8 mm. Therefore, the section Sf1 is 4.5 mm2 and the section Sf2 is 1.89 mm2, and hence the ratio therebetween is 42%.

This fuse is designated in FIG. 4 as "FUSE A". The performance of this fuse has been compared with those of a standard fuse, designated as "FUSE B", which has no second fuse 40, and has a fuse element with a width Wf1 of 2.5 mm and electric contacts with a contact width Wc of 13.7 mm.

FIG. 4 shows the melting time vs current curves at a temperature of 23° C. for the fuses FUSE A and FUSE B, and the ISO maximum and minimum curves (ISO MAX and ISO min).

It will be appreciated that the behaviors of both fuses meet the ISO prescribed limits (up to 6 times the rated current I_0), but at higher values the fuse FUSE B has an asymptotic behavior, which does not ensure short operation times, whereas the fuse FUSE A has a curve with continuously decreasing operation times.

As is shown from the above, the present invention fulfills the intended objects. Particularly, the use of a fuse element having a part of smaller width ensures adequate operation times at both low and high overcurrent values.

Those skilled in the art will obviously appreciate that a number of changes and variants may be made to the invention as described hereinbefore to meet specific needs, without departure from the scope of the invention, as defined in the following claims.

The invention claimed is:

1. A fuse comprising:

a first electric contact extending in a prevailing longitudinal contact direction and comprising a first contact portion, which is designed to establish an electric contact with a first mating contact, and a first contact end, said first electric contact having, at least at said first contact end, a first contact width extending in the direction perpendicular to said longitudinal contact direction, a second electric contact extending in said prevailing longitudinal contact direction and comprising a second contact portion, which is structured and arranged to establish an electric contact with a second mating contact, and a second contact end, said second electric contact having, at least at said second contact end, a second contact width extending in the direction perpendicular to said longitudinal contact direction, a fusible element extending in a prevailing longitudinal fuse direction along a fuse length between a first fuse end and an opposed second fuse end, the first fuse end being directly connected and located immediately adjacent to the first contact end, the second fuse end being directly connected and located immediately adjacent to the second contact end, a casing defining a housing for said fusible element and for at least part of said first and second electric contacts, said fusible element comprising:

a first fuse extending in the longitudinal fuse direction along a first fuse length between the first fuse end and a connecting end, said first fuse having, at a minimum-section portion thereof, a first fuse width in the direction perpendicular to said longitudinal fuse direction, and a first fuse cross-section, at least one second fuse extending in the longitudinal fuse direction along a second fuse length between said connecting end and said second fuse end, such that said second fuse is connected in series to said first fuse and is disposed between said first fuse and said second fuse end, wherein:

said second fuse comprises a narrowed part with a second fuse width in the direction perpendicular to said longitudinal fuse direction, and a second fuse cross-section, said second fuse cross-section ranges from 20% to 50% of said first fuse cross-section, said first fuse width is smaller than said first and second contact widths, said second fuse width is smaller than said first fuse width and said first and second contact widths, said narrowed part is located near said second fuse end, said narrowed part is placed near said second contact end of said second electric contact so that said second electric contact is immediately adjacent to said narrowed part.

2. A fuse as claimed in claim 1, wherein said second fuse width ranges from 20% to 50% of said first fuse width, with said fusible element having a constant thickness.

3. A fuse as claimed in claim 1, wherein said second fuse length is in a range between said second fuse width and 3 times said second fuse width.

4. A fuse as claimed in claim 1, wherein said second fuse extends along said second fuse length with a substantially constant width, equal to said second fuse width.

5. A fuse as claimed in claim 1, wherein said second fuse comprises at least one tapered part for connecting said narrowed part with one of said connecting end and said second fuse end, said at least one tapered part having a width increasing from said second fuse width to said first fuse width or said second contact width.

6. A fuse as claimed in claim 1, wherein said second fuse comprises two tapered parts for connecting said narrowed part with said connecting end and with said second fuse end respectively, said two tapered parts having a width increasing from said second fuse width to said first fuse width and said second contact width respectively.

* * * * *